United States Patent [19]

Calenda et al.

[11] Patent Number: 4,498,069

[45] Date of Patent: Feb. 5, 1985

[54] ELECTRIC SWITCHES ACTUATED BY BIMETALS FOR ONE OR SEVERAL TEMPERATURES OF RESPONSE

[75] Inventors: Ciro Calenda; Pietro De Filippis, both of Aversa; Amedeo Salvatore, Napoli, all of Italy

[73] Assignee: Texas Instruments Incorporated, Dallas, Tex.

[21] Appl. No.: 453,553

[22] Filed: Dec. 27, 1982

[30] Foreign Application Priority Data

Dec. 4, 1981 [IT] Italy ..... 49846A/81

[51] Int. Cl.[3] ..... H01H 37/52

[52] U.S. Cl. ..... 337/354; 337/380

[58] Field of Search ..... 337/354, 380, 381, 370, 337/371, 62

[56] References Cited

U.S. PATENT DOCUMENTS 3,139,500 6/1964 Fallon et al. ..... 337/354

3,500,278 3/1970 Them ..... 337/354

3,943,480 3/1976 Schmitt ..... 337/354

*Primary Examiner*—Harold Broome

*Attorney, Agent, or Firm*—James P. McAndrews; John A. Haug; Melvin Sharp

[57] ABSTRACT

An electric switch or commutator actuated by bimetals for one or several temperatures of response comprises a cap support for one or several bimetallic disks of a well known type which cooperates with a base made of one piece, the base comprising a substantially cylindrical part disposed to join with the cap support for mounting the bimetallic disks and having rivets extending through the cylindrical base part into an integral part of the base which mounts fixed and movable contacts of the switch and which is disposed to support also the connecting terminals and a covering and protecting element with snap-action insertion.

4 Claims, 5 Drawing Figures

ELECTRIC SWITCHES ACTUATED BY BIMETALS FOR ONE OR SEVERAL TEMPERATURES OF RESPONSE

BACKGROUND OF THE INVENTION

The present invention concerns an improvement in electric switches or commutators actuated by bimetals for one or several temperatures of response.

Electric commutators or switches actuated by bimetals for one or several temperatures of response are well known in the prior art. These devices comprise one or several bimetallic disks selected so as to operate at different temperatures, said bimetallic disks actuating elements for transferring disk movement to movable contacts so as to effect switching operations for apparatus controlled by the said device. Conventional switch devices of this sort are less compact then would be desired and have configurations such that they are not easily shipped and are not easily accommodated on apparatus whose temperatures are to be monitored.

SUMMARY OF THE INVENTION

One of the objects of the present invention is to provide an improved configuration for an electric switch or commutator of the type mentioned above, said configuration being compact, of inexpensive design, and complying with insulation requirements between terminals as required in household appliances.

According to the present invention, the electric switch or commutator actuated by bimetals for one or several temperatures of response comprises a cap support for one or several bimetallic disks cooperating with a base made of one solid piece having a substantially cylindrical part disposed so as to join with the said cap support for mounting the bimetallic disks. Said substantially cylindrical part of the base is integral with a second part of the base which mounts the fixed and movable contacts of the switch or commutator, and which is provided with means for supporting also connection terminals and a covering and protecting element with snap-action insertion. Rivets extend through the cylindrical part of the base into the contact mounting part of the base for securing the switch contacts and terminals to the base, the rivets having heads recessed into the cylindrical base part to be accommodated in the same part of the base which mounts the bimetallic disks and to be electrically isolated from the disk and mounting cap and to be inexcessible from outside the switch.

DESCRIPTION OF THE DRAWINGS

The present invention will now be described with reference to a presently preferred embodiment thereof, said embodiment being given by way of example only, and in view of the attached drawings, in which.

DESCRIPTION OF PREFERRED EMBODIMENTS

Figure 1:
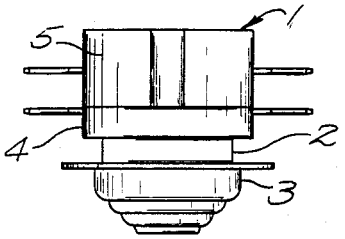
FIG. 1 shows a lateral view of a preferred embodiment of the bimetal switch or commutator of the present invention.
Figure 2:
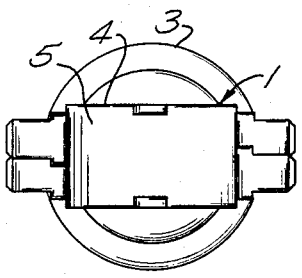
FIG. 2 shows a top plan view of the switch of FIG. 1.

Referring now to FIGS. 1 and 2, the switch or commutator actuated by bimetals is denoted at 1 and comprises a body having a cylindrical part 2 disposed to join with a cap support 3 for the bimetallic disk, the cap support being made of forged or drawn metal. The cylindrical part 2 of the base is in one piece with a second base part substantially of parallel piped configuration denoted in its entirety as 4 and disposed so as to support the fixed and movable contacts and connecting terminals of the switch as will be seen further below. Above part 4, a protecting and insulating lid 5 is inserted in a snap-action fit on the base part 4.

Figure 3:
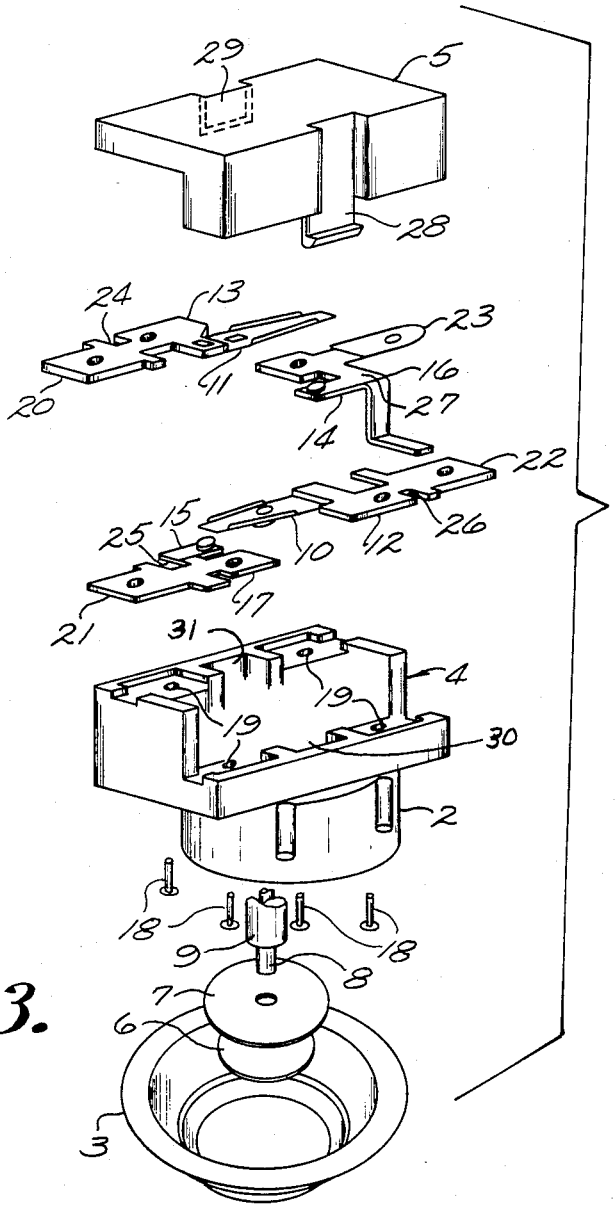
FIG. 3 shows an exploded view to enlarged scale of the components of the bimetal switch or commutator of FIGS. 1 and 2.
Figure 5:
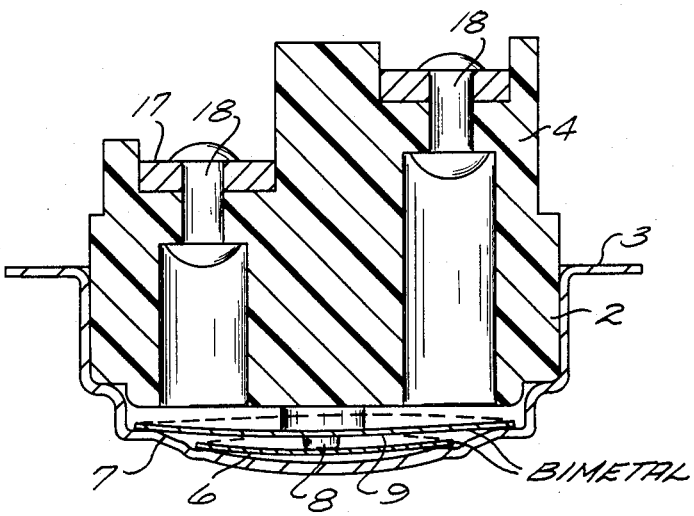
FIG. 5 is a partial section view along line 5—5 of FIG. 4 illustrating a construction feature of this invention.

Referring to FIGS. 3 and 5, the inner structure is shown. The said cap support 3 is disposed so as to support in a known manner a pair of dished, thermally responsive bimetallic disks 6, 7. The bimetallic disks are adapted to move with snap action from the original dished configurations shown in FIGS. 3 and 5 to inverted dished configurations indicated by broken lines *6a* and *7a* in FIG. 5 in response to heating to respective different temperatures. The disks are also adapted to return to their original dished configurations with snap action when the disks are subsequently cooled. The disk 7 is perforated in a known manner so as to allow an actuating rod 8 to pass through, said actuating rod being concentric with a second tubular actuating rod 9 telescoped therewith so as to control the movable contacts 10, 11 respectively. The said movable contacts 10, 11 are welded onto contact supports 12, 13. The said movably contacts 10, 11 cooperate with fixed contacts 14, 15 mounted on contact supports 16 and 17 respectively. The said fixed and movable contacts 10, 11 and 14, 15 cooperate in a known manner for opening and closing respective electrical circuits, the movable contacts 10, 11 being normally biased to engage contacts 15 and 14 respectively in closed circuit positions but being movable by the rods 8 or 9 to open circuits. The supports of the fixed and movable contacts 12, 13, 16 and 17 are fastened to the second base part 4 of the switch by means of four fastening elements, preferably rivets, denoted at 18 which pass through holes 19 in the base of the switch.

It should be noted that said rivets 18 are located inside the cylindrical part 2 of the body of the switch and the heads of the rivets are necessarily recessed into the cylindrical part of the base 2 so as to be protected and electrically isolated from the bimetallic disk and the support 3. As will be understood, heads on the opposite ends of the rivets secure the contact supports 12, 13, 16 and 17 on the base as is shown in FIG. 5.

The actual connection terminals denoted as 20, 21, 22 and 23 are part of contact supports 12, 13 and 16, 17 but are "separated" in regard to mechanical stresses and deformations from the riveted parts of the contact supports by means of cutouts 24, 25, 26 and 27. This is in order to prevent stresses and deformations on the terminals from being transmitted to the contacts for altering the predetermined calibration of the movable contacts 10 and 11 in the switch or commutator.

Above the structure as described above, a lid 5 is inserted with a snap-action fit, said lid being provided with tongues 28, 29 which fit into and snap into openings 30, 31 in the base.

Figure 4:
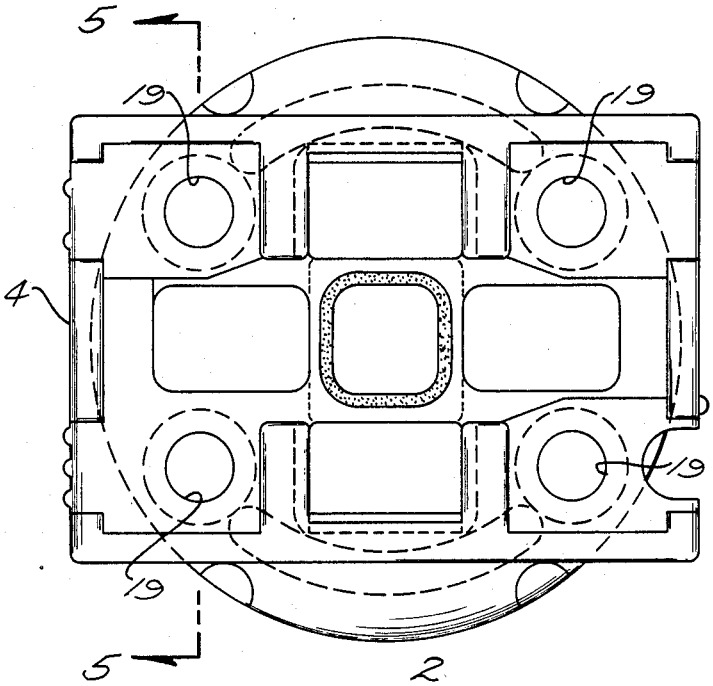
FIG. 4 shows a top view of the body of the switch or commutator wherein all the components used in the device have been removed.

It is seen that in the device according to the present invention, the connecting terminals are appreciably spaced apart so as to comply with the required norms for electrical appliances. FIG. 4 clearly shows the relation between the seats of the various contacts and metallic parts described above; it also demonstrates the fact that the holes 19 for the rivets firmly holding the various mechanical parts together are located inside the circumference defined by the part 2.

The required calibration for the respective response temperatures can be made by means of a slight deformation of the supports of the fixed and/or movable contacts in conventional manner as described in other patents.

It should be noted that the element 3 for supporting the bimetallic disks is preferably made from a laminate composed, for example, from stainless steel and aluminum so as to utilize the chemical resistance of stainless steel as well as the superior heat-transfer and mechanical flexibility properties of aluminum.

The present invention has been described by way of a preferred embodiment thereof. It should be understood, however, that variations and modifications can be made in this invention by one skilled in the art without departing from the scope of protection of the invention as specified in the following claims.

I claim:

1. An electrical switch comprising a base made of a single piece having a first substantially cylindrical part and having an integral second part disposed at one end of the first cylindrical base part, at least one thermally responsive dished bimetallic disk mounted at an opposite end of the first cylindrical base part to move with snap action between original and inverted dished configurations in response to selected changes in temperature, a metal cap fitted over said opposite end of the first cylindrical base part for mounting the disk on the base part to be disposed adjacent an object whose temperature is to be monitored, fixed contact means disposed on said second base part, movable contact means disposed on said second base part to be movable into and out of engagement with said fixed contact means between open and closed circuit positions and to be biased into one of said circuit positions, motion transmitting means slidably mounted for movement along the axis of said first cylindrical base part between the disc and movable contact means for moving said movable contact means to the other of said circuit positions, and rivet means securing the fixed and movable contact means to the second base part, characterized in that the rivet means extend axially through said first cylindrical part of the base, the rivet means having head means at one end securing said fixed and movable contact means to said second base part and the rivet means having head means at an opposite end accommodated in recesses which open into said opposite end of said first cylindrical part of the base under said bimetallic disk in electrically isolated relation to said disc and cap to be protected by the disk and cap to be inaccessible from outside the switch.

2. Electric switch actuated by bimetals comprising a base made of a single piece having a first substantially cylindrical part and having an integral second part disposed at one end of the first cylindrical base part, at least one thermally responsive dished bimetallic diisc mounted at an opposite end of the first cylindrical base part to move with snap action between original and inverted dished configurations in response to selected change in temperature, a metal cap fitted over said opposite end of the first cylindrical base part for mounting the disc on the base part to be disposed adjacent an object whose temperature is to be monitored, fixed contact means disposed on said second base part, movable contact means disposed on said second base part to be moveable into and out of engagement with said fixed contact means between open and closed circuit positions and to be biased into one of said circuit positions, motion transmitting means slidably mounted for movement along the axis of said first cylindrical base part between the disc and movable contact means for moving said movable contact means to the other of said circuit positions, and rivet means extending axially through said first cylindrical base part having head means at one end securing said fixed and movable contact means to said second base part and having head means at an opposite end fitted into recesses in said opposite end of said first cylindrical base part to to be accommodated under said bimetallic disc in electrically isolated relation to said disc and cap to be protected and to be inaccessible from outside the switch, characterized in that anchoring terminals for making electrical connections to said respective contacts further include and are joined with supports for said fixed and movable contacts by metallic parts of said supports which are provided with notches between the terminals and contacts so as to prevent a transfer of strains and stresses from said connection terminals to said contacts.

3. An electric switch actuated by bimetals as set forth in claim 2 further characterized in that said connection terminals are offset in horizontal and vertical planes with respect to each other.

4. Electrical switch actuated by bimetals as set forth in claim 3 further characterized in that said metal cap support for the bimetallic disk is composed of a composite material comprising different metals.

* * * * *